United States Patent [19]

Berfield

[11] 4,270,668

[45] Jun. 2, 1981

[54] BUCKLE OR LATCH FOR HOLDING LID TO CONTAINER

[75] Inventor: Robert C. Berfield, Jersey Shore, Pa.

[73] Assignee: Shop-Vac Corporation, Williamsport, Pa.

[21] Appl. No.: 118,786

[22] Filed: Feb. 5, 1980

[51] Int. Cl.[3] ..... B65D 45/16

[52] U.S. Cl. ..... 220/324; 292/87; 292/103; 292/DIG. 38

[58] Field of Search ..... 220/324; 292/87–89, 292/101, 107, 103, 116, 120, DIG. 38, 202, 204, 213, 218

[56] References Cited

U.S. PATENT DOCUMENTS

| | | | |
|---|---|---|---|
| 3,546,752 | 12/1970 | Sargent | 220/324 X |
| 3,822,905 | 7/1974 | Bell | 292/87 |

*Primary Examiner*—George T. Hall

*Attorney, Agent, or Firm*—Ostrolenk, Faber, Gerb & Soffen

[57] ABSTRACT

The disclosure concerns a buckle or latch for maintaining a lid in place on a container, such as a vacuum cleaner tank. The buckle includes a mounting bracket attached to the container. The bracket has a slot spaced down from the lid for receiving a hinge pin. The buckle includes a buckle element with a lower end having a hinge pin thereon which is swivelably held in the slot in the bracket. The buckle element has a hook at its upper end to snap over a detent on the edge flange of the lid. An upwardly facing abutment on the swiveling buckle element and located between the hinge pin and the hook is arranged so that it will engage a downwardly facing abutment on the mounting bracket when the buckle is closed. Upon attempted separation of the lid and container while the buckle is in place, any forces on the buckle are transmitted to the abutment of the buckle and then to the abutment on the mounting bracket and not to the hinge pin.

18 Claims, 6 Drawing Figures

BUCKLE OR LATCH FOR HOLDING LID TO CONTAINER

BACKGROUND OF THE INVENTION

The present invention relates to a buckle or latch for securing a lid to an open topped container. The invention has particular application to a buckle utilized for securing a lid to the top of the tank of a tank type vacuum cleaner.

Various lid buckles are known including a toggle type buckle arrangement wherein the buckle, pivotally supported on the tank, may engage a projecting portion or rim of the lid and lock the same in place upon closure of the toggle. Other types of buckles are latched to the lid in various ways.

In known buckles using a swiveling or pivoting latch element, the mechanical strain involved in holding the lid to the container is taken up by the means by which the buckle is movably attached to the container, i.e. the means on which the buckle swivels, e.g. a hinge pin of the buckle or latch. Repeated application of force tending to separate the lid from the tank is transmitted to the swivel means or hinge pin, eventually deforming the hinge pin or damaging the swivel means, which adversely affects the operation of the buckle.

SUMMARY OF THE INVENTION

The primary object of the present invention is to provide a hinged buckle or latch which is typically secured to the container, e.g. the tank of a tank type vacuum cleaner, for maintaining a lid in place on the container or tank, wherein the means movably attaching the buckle to the container, i.e. swivel means, e.g. the hinge pin, of the buckle is relieved of the stress applied to maintain the lid on the tank.

It is a related object to transfer the stress to another element of the buckle which is better able to absorb the stress.

According to the present invention, a buckle or latch is movably, e.g. swivelably secured to the container by a hinge pin for maintaining the lid in position on the container, wherein the force exerted in maintaining the lid on the container is transferred to a pair of cooperating abutments, one on the buckle and one on the container, so that any force tending to separate the lid from the container while the buckle is in a closed position, acts upon the two abutments and is not transferred to the means movably attaching the buckle to the container, i.e. swivel means, e.g. the hinge pin of the buckle.

The foregoing and other objects and features of the present invention will become apparent in the following description and accompanying drawings.

DESCRIPTION OF A PREFERRED EMBODIMENT

Figure 1:
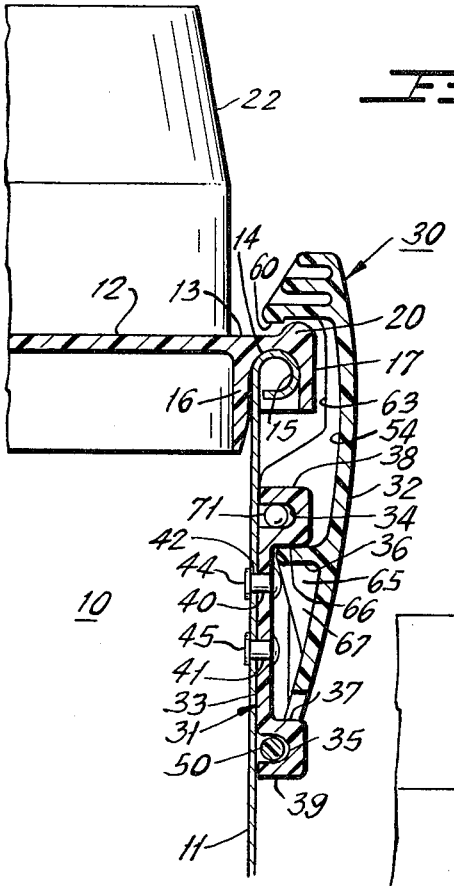
FIG. 1 is a view partly in cross-section showing a container and lid combination with the buckle of the present invention in the closed position to secure the lid to the container.
Figure 2:
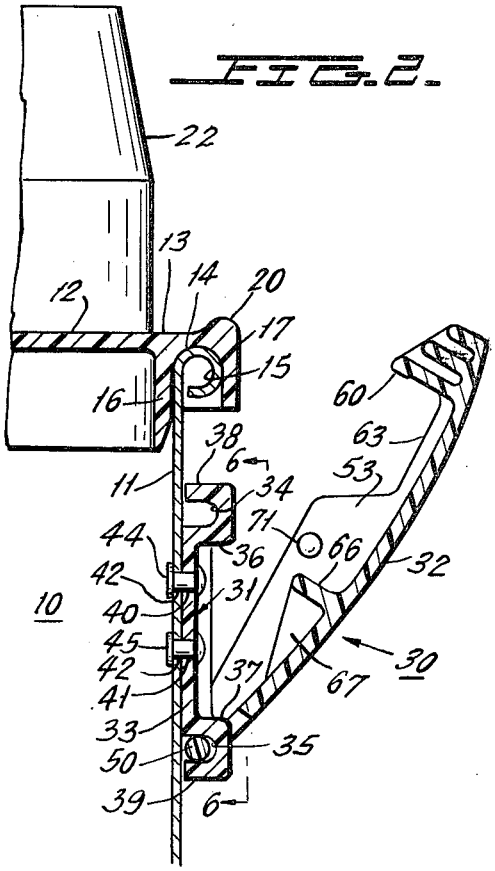
FIG. 2 is a view corresponding to that of FIG. 1 showing the buckle released from the lid.

Referring to FIGS. 1 and 2, a container 10 with which the invention is used is the tank of a tank type vacuum cleaner having a cylindrical wall 11, part of which is shown in FIGS. 1 and 2, and a lid 12. The lid 12 has a circular, peripheral flange 13 integrally secured to it. The flange defines an annular downwardly opening recess 14, which receives the bead 15 at the top of the tank wall 11 when the lid 12 is placed on the tank 10. The annular recess 14 is defined by the circular, inward skirt wall 16 extending downwardly from the flange 13 and by the circular outward skirt wall 17 extending downwardly from the flange 13 parallel to the circular wall 16. At its outer periphery, virtually as an extension of the wall 17 and extending above a portion of the annular recess 14, the flange 13 has an upwardly extending annular rib 20 to be overhung by and engaged by the hook 60 of the buckle.

The blow motor and fan (not shown) of the vacuum cleaner are encased in the housing 22 above the lid 12.

The latch or buckle 30 is comprised of two principal parts, a mounting bracket 31, and the rotatable buckle element 32. Preferably, the entire buckle element 32 and the entire bracket 31 are comprised of molded plastic.

Figure 6:
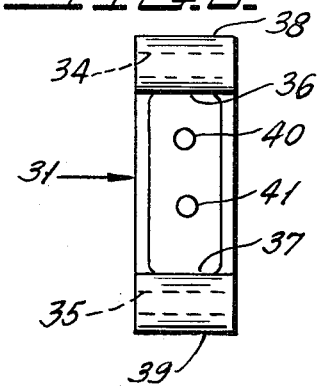
FIG. 6 is a view of the mounting bracket for the buckle, taken from line 6—6 of FIG. 2 looking in the direction of the arrows.
Figure 3:
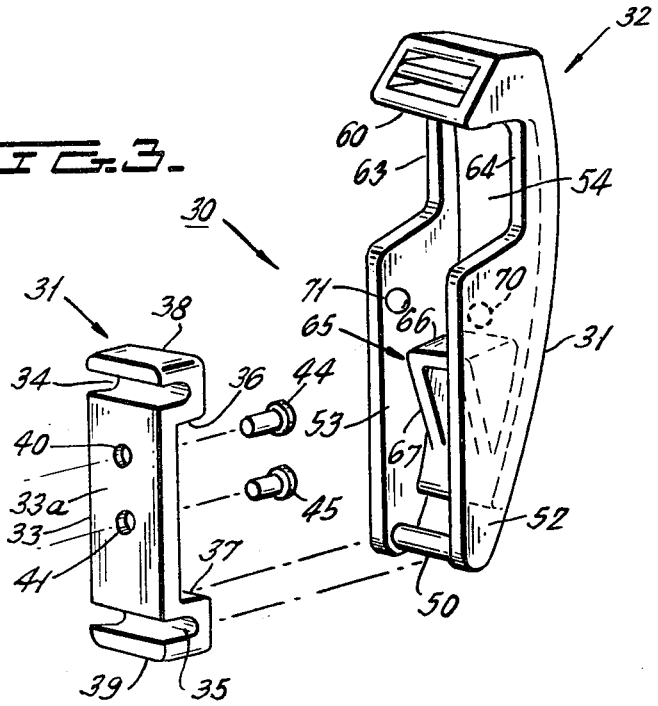
FIG. 3 is an exploded perspective view showing the buckle and the mounting bracket therefor.
Figure 4:
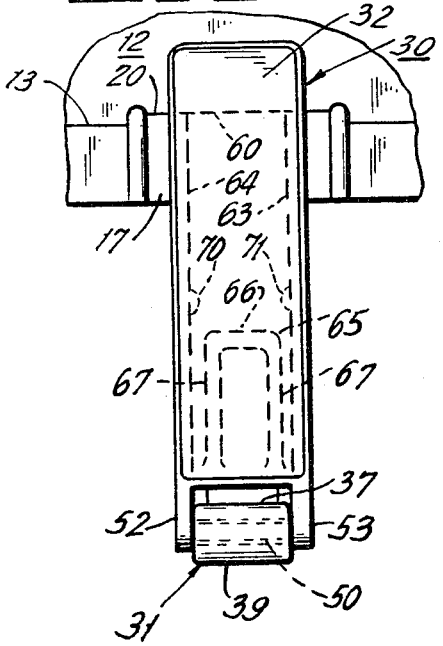
FIG. 4 is an elevational view taken from the right side in FIGS. 1-3.
Figure 5:
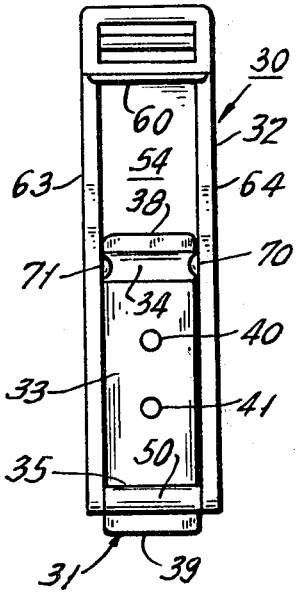
FIG. 5 is an elevational view of the assembled buckle taken from the opposite, left side of FIGS. 1-3.

The mounting bracket 31, as seen in FIGS. 2, 3 and 6, comprises a main section 33 and two identically shaped, horizontally slotted, end sections 34 and 35. The face **33*a* of the main section 33 is applied to the surface of the tank wall 11. A pair of mounting holes 40 and 41 are provided in the main section 33. Aligned mounting holes 42 are formed in the tank wall 11. Rivets 44 and 45 project through the aligned mounting holes to secure the mounting bracket 31 to the tank wall 11**, whereby the bracket effectively becomes part of the tank wall.

The slotted sections 34, 35 of the bracket 31 are upraised off the tank wall 11. The sections are each defined at one respective side thereof by the inward abutment walls 36 and 37, which extend in a direction such that each will obstruct the movement of the buckle element 32 that occurs upon attempted separation of the lid and the tank, i.e. a direction that intersects the tank wall 11, and they are opposed to each other. As illustrated, the walls 36 and 37 are substantially normal to the main section 33. The sections 34, 35 are also defined at the opposite, outward respective side thereof by the slot forming walls 38 and 39, which parallel, respectively, the abutment walls 36 and 37.

Mounting openings 40, 41 in bracket section 33 are offset vertically to accommodate two different spacings of the mounting bracket 31 and buckle member 32 from the top of the tank 10, as the size and shape of a particular tank 10 dictates. Thus, when the mounting bracket 31 is in the orientation shown in FIG. 3 with the mounting opening 40 upward, the abutment wall 36 is closer to the top of the tank wall 11 than when the mounting bracket 31 is inverted to bring the mounting opening 41 upward. In the latter instance, the abutment 37 will be further from the top of the container, where the same openings 42 in the tank side are to be used for either orientation of the buckle.

In the bracket orientation shown in the Figures, the abutment wall 36 relieves the strain on the hinge pin 50 of the buckle. The slot 34, in this instance is a detent receiver for holding the buckle element 32 closed, and the slot 35 acts as the receiver for the pivot pin 50 of the buckle element.

The buckle element 32 is provided with means that connect it to the bracket 31, i.e. a swivel means, e.g. a pivot pin 50, located at its bottom end. The pin 50 is received in the slot 35 of the bracket 31 and is held therein prior to the securement of the bracket 31 to the tank wall 11. When the bracket 31 is secured to the tank wall 11, the pivot pin 50 is permanently but pivotally secured within the slot 35 and comprises an effective hinge pin for the buckle 32. The position of the hinge pin 50 is beneath the abutment 36, which abutment cooperates with the buckle element 32 to keep the buckle element closed, and the hinge pin is also further from the lid than the abutment 36.

Although not illustrated, it is apparent that a hinge pin could be provided on the bracket 31 while a slot for receiving the hinge pin could then be included on the buckle element 32.

The buckle element 32 has upstanding, opposite side walls 52 and 53, and principal wall 54 which connects the two side walls. The side walls 52 and 53 should, for purposes hereinafter described, have some compliance or resilience.

The principal wall 54 and the side walls 52 and 53 are extended to form the lid engagement section 60 of the buckle, which is generally in the form of a hook. The engagement section 60 snaps over the detent rib 20 of the flange 13 of the lid 12 in order to secure the lid 12 to the container 10. In FIG. 1, it can be seen that while the engagement section 60 of the buckle 32 element snaps over the detent rib 20 of flange 13 of the lid 12, it need not necessarily bear against the upwardly extending rib 20.

The recesses 63, 64 in the side walls 53 and 52 of the buckle element 32 enable the side walls to clear the outer rim 17 of the flange 13 so that the member 60 may extend over the detent rib 20.

The principal wall 54 carries an abutment member 65, which is integral with the principal wall. The abutment member 65 includes an upwardly facing wall 66 for engaging an abutment wall 36 or 37 when the buckle element is closed. The side walls 67 of the abutment member 65 rigidify wall 66. This abutment member extends in a direction such that when the buckle element 32 is closed, the abutment member wall 66 will engage the one of abutment walls 36 and 37 that is then uppermost upon attempted separation of the lid and the tank, thereby obstructing that movement of the buckle element 32 that accompanies separation of the lid and the tank. As illustrated, the abutment member wall 66 extends in a direction that intersects the tank wall 11, and particularly, it extends normally to the tank wall when the buckle element 32 is closed. The abutment member 65 is so positioned on wall 54 that when the buckle element 32 is swung to the closed position, the abutment member wall 66 extends just beneath the abutment wall 36 and is in contact therewith. Any force tending to separate the lid 12 from the tank 10, will be taken by the engagement between the abutments 65 and 36 and will not be transmitted to the hinge pin 50 of the buckle.

While the buckle is shown in somewhat open position in FIG. 2, in actual use once the buckle is opened, the buckle member 32 will simply rotate with its pin 50 in the slot 35 to a position in which it hangs down from the pin 50. The force exerted on the pin 50 is only the minute weight of the buckle element 32, rather than any holding force which may be necessary to resist separation of the lid from the tank.

When the vacuum cleaner is turned on, the drawing of the vacuum in the tank 10 will result in the lid 12 being pulled down onto the top 15 of the tank wall 11. The downward movement, however, should be of such minimal extent that the engagement member 60 of the buckle 32 will not be disengaged from the detent rib 20 on the lid.

As will be seen from FIG. 1, while the buckle element 32 is essentially maintained closed by the engagement member 60 and the upwardly extending detent rib 20 on the lid, this interengagement is somewhat loose, since the cooperating abutment members 65 and 36 resist separation of the lid from the tank. Consequently, additional detent means maintain the buckle element 32 closed. Detent projections 70 and 71 are provided inside each of the side walls 52 and 53 of the buckle element. The detent projections 70 and 71 register with the ends of the slot 34 at the upper end of the bracket 31 and snap therein when the buckle is swiveled from the open position to the closed position of FIG. 1. The side walls 52 and 53 are sufficiently resilient to permit this snap detent action to occur.

In the foregoing the present invention has been described in connection with an illustrative embodiment. Since many variations and modifications of the present invention will now be obvious to those skilled in the art, it is preferred that the scope of this invention be determined not by the specific disclosures herein contained, but only by the appended claims.

What is claimed is:

1. A latch or buckle for latching a lid to a container, wherein said buckle comprises:

a mounting bracket for being secured to the wall of the container, said mounting bracket including an abutment thereon extending to a position where said bracket abutment will engage a cooperating abutment of the buckle upon attempted separation of the container and the lid;

a buckle element which is relatively movably connected to said mounting bracket at a location on said mounting bracket that is further from the lid to be held by said buckle than said mounting bracket abutment; said buckle element including a lid engaging portion positioned such that when said buckle element is moved to a first position thereof, said lid engaging element is in engagement with a lid of the container, and when said buckle element is moved to a second position thereof, said engaging element is out of engagement with that lid over the container; the aforesaid cooperating abutment being on said buckle element and moving therewith and being so shaped and so positioned on said buckle element that when said buckle element is in said first position thereof, said buckle element cooperating abutment is in engagement with said bracket abutment such that the engagement between said buckle element abutment and said bracket abutment obstructs such movement of said buckle element in a manner that would permit lifting of the lid off the container, whereby forces which are directed toward separating the lid from the container are generally absorbed between the cooperating said abutments, rather than at said movable connection between said bracket and said buckle element.

2. The buckle of claim 1, wherein said bracket abutment extends in a direction that is across a wall of a container to which said mounting bracket is affixed.

3. The buckle of claim 1, wherein said bracket abutment comprises a surface extending outwardly of the wall of the container to which said bracket is mounted and said buckle element cooperating abutment comprises a surface extending generally inwardly toward the wall of the container to which said bracket is mounted.

4. The buckle of either of claims 1 or 3, wherein said bracket includes means for securing said bracket to a container.

5. The buckle of claim 1, wherein said relatively movable connection of said buckle element to said mounting bracket is a swivel connection therebetween.

6. The buckle of claim 5, wherein said bracket includes two spaced apart relatively movable connection locations thereon, each being adapted to be movably connected to said buckle element and said buckle element being connected to only one said relatively movable connection and extending up past the other said relatively movable connection; said securing means on said bracket being nearer to one said relatively movable connection than to the other said relatively movable connection; said bracket also having two spaced apart, opposed said bracket abutments so placed that said buckle element abutment will engage a respective said bracket abutment depending upon which said relatively movable connection that said buckle element is connected to.

7. The buckle of claim 5, wherein said swivel connection comprises a hinge pin defined on one of said buckle element and said bracket and a hinge pin receiving slot defined on the other of said buckle element and said bracket in which said hinge pin is received.

8. The buckle of claim 7, wherein said hinge pin is on said buckle element and said slot is defined in said bracket.

9. The buckle of claim 8, wherein said bracket has a side thereof which faces toward a container when said bracket is attached to the container and said slot in said bracket is open toward that said side of said bracket, whereby said slot is closed when said bracket is secured to a container.

10. The buckle of either of claims 1 or 7, further comprising detent means for separably holding said buckle element in said first position thereof and for permitting said buckle element to be moved to said second position thereof.

11. The buckle of claim 10, wherein said detent means comprises a projection on said buckle element and a slot on said bracket into which said projection may extend and said projection on said bracket being supported on a resilient portion of said bracket, such that said projection may snap into and out of the said detent slot in said bracket for holding said buckle element in said first position thereof.

12. The buckle of claim 1, wherein said engaging portion of said buckle element comprises a hook portion for overlying a lid positioned over the top of a container.

13. In combination, the buckle of claim 1, a container having a side wall and a lid positionable over the top of the container side wall;

said mounting bracket being secured to said container side wall generally near said lid; said buckle element being of a length such that said engaging portion thereof extends above and over said lid when said lid is positioned over said tank wall and when said buckle element is in said first position thereof.

14. The combination of claim 13, wherein said lid has a generally peripheral, upwardly projecting flange and said engaging portion of said buckle element is shaped for passing over said flange and for defining a groove into which said lid flange moves upon attempted separation of said lid from said container.

15. A latch or buckle assembly for latching a lid to a container, wherein said assembly comprises:

a container having a side wall such that a lid may be mounted on the end of said side wall; a container abutment secured on said container side wall; said container abutment extending to a position where said container abutment will engage a cooperating abutment of the buckle upon attempted separation of said container and a lid on the end of said container side wall;

a buckle element, which is relatively movably connected to said container side wall at a location that is further from a lid to be held by said buckle element than said mounting bracket abutment; said buckle element including a lid engaging portion positioned such that when said buckle element is moved to a first position thereof, said lid engaging element is in engagement with a lid on said container, and when said buckle element is moved to a second position thereof, said lid engaging element is out of engagement with that lid on said container; the aforesaid cooperating abutment being on said buckle element and moving therewith and being so shaped and so positioned on said buckle element that when said buckle element is in said first position thereof, said buckle element cooperating abutment is in engagement with said container abutment, such that the engagement between said buckle element abutment and said container abutment obstructs such movement of said buckle element in a manner that would permit lifting of the lid off said container, whereby forces which are directed toward separating the lid from said container are generally absorbed between the cooperating said abutments, rather than being absorbed at said movable connection between said container and said buckle element.

16. The assembly of claim 15, wherein said relatively movable connection of said buckle element to said container is a swivel connection therebetween.

17. The assembly of either of claims 15 or 16, wherein said container abutment extends in a direction that is across said wall of said container to which said buckle element is movably connected.

18. The assembly of claim 17, wherein said container abutment comprises a surface extending outwardly of said container wall to which said buckle element is movably connected and said buckle element cooperating abutment comprises a surface extending generally inwardly toward said wall of said container to which said buckle element is movably connected.

* * * * *